US007063186B1

(12) United States Patent
Granke

(10) Patent No.: US 7,063,186 B1
(45) Date of Patent: Jun. 20, 2006

(54) SAFETY RAIL

(76) Inventor: Gary J. Granke, 712 Corte de Encinitas, Camarillo, CA (US) 93010

( * ) Notice: Subject to any disclaimer, the term of this patent is extended or adjusted under 35 U.S.C. 154(b) by 192 days.

(21) Appl. No.: 10/814,746

(22) Filed: Apr. 1, 2004

(51) Int. Cl.
*A47L 3/02* (2006.01)
*E04G 1/16* (2006.01)
*E06C 7/18* (2006.01)

(52) U.S. Cl. ..... 182/113; 182/106

(58) Field of Classification Search ..... 182/113, 182/106, 112, 45, 3, 36; 256/DIG. 6, 59, 256/1; 52/DIG. 12, 9
See application file for complete search history.

(56) References Cited

U.S. PATENT DOCUMENTS 2,315,516 A * 4/1943 Gray ..... 256/1
3,662,993 A * 5/1972 Lionetto ..... 256/59
3,880,405 A * 4/1975 Brueske ..... 256/59
3,964,215 A * 6/1976 Hartman et al. ..... 52/9
4,030,255 A * 6/1977 Hartman ..... 182/106
5,683,074 A * 11/1997 Purvis et al. ..... 182/113
6,068,084 A * 5/2000 Taormina ..... 182/113
6,279,880 B1 * 8/2001 Hawks, Jr. ..... 256/67

* cited by examiner

*Primary Examiner*—Hugh B. Thompson, II
(74) *Attorney, Agent, or Firm*—Albert O. Cota

(57) ABSTRACT

A portable modular safety rail (20) is taught for protecting workers during building construction and remodeling. The invention in the preferred embodiment consists of two upright stanchions (22) having a flat mounting plate (36) on the bottom which is removably attached with fasteners onto a building. A number of connection members, in the form of round rings (46), protrude from the sides of each stanchion. Two adjustable length rails (56) that are rigid and telescope together engage the connection members on each end with pivotal attachment means consisting of safety snap pins (68) that fasten the rails with the assembly forming the safety rail module. The safety rail module may be horizontal when the stanchions are attached to a level surface or may be angled to accommodate stairs. A second embodiment substitutes chains (64) instead of the adjustable telescoping rails.

14 Claims, 8 Drawing Sheets

FIG. 24
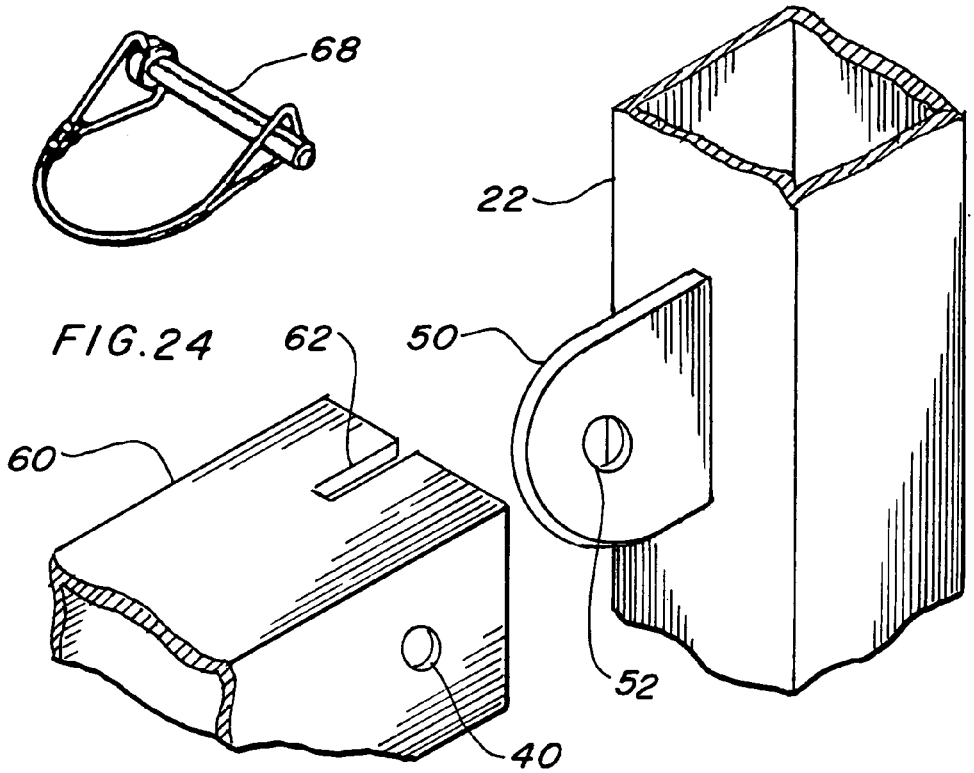
FIG. 22
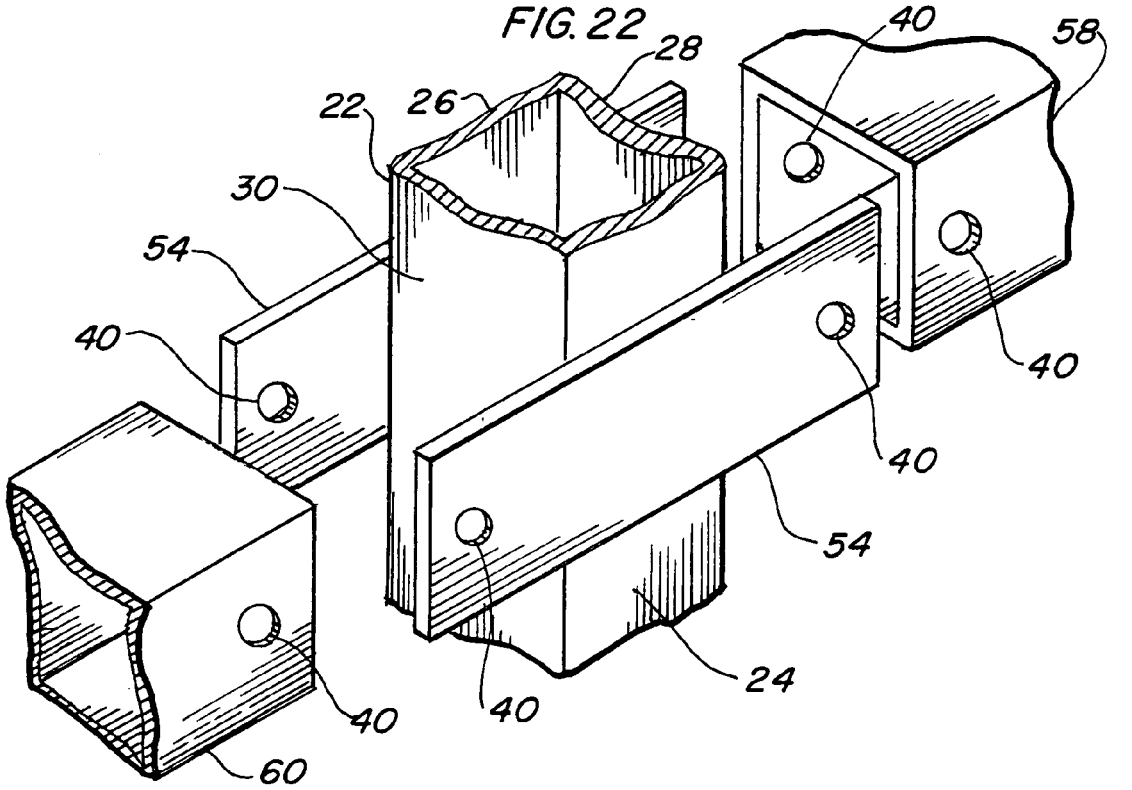
FIG. 23

SAFETY RAIL

TECHNICAL FIELD

The present invention relates to safety rails in general, and more specifically to a portable modular safety rail for building construction capable of utilizing rigid telescoping rails, or chains on flat surfaces and stairways.

BACKGROUND ART

Previously, many types of safety or guard rails have been used to provide an effective means to protect workers during building construction and remodeling.

The prior art listed below did not disclose patents that possess any of the novelty of the instant invention; however the following U.S. patents are considered related:

| U.S. Pat. No. | Inventor | Issue Date |
|---|---|---|
| 5,522,472 | Shuman, Jr. et al. | Jun. 4, 1996 |
| 6,016,889 | Pearcy et al. | Jan. 25, 2000 |
| 6,053,281 | Murray | Apr. 25, 2000 |
| 6,068,084 | Taormina | May 30, 2000 |
| 6,334,507 | Westerweel | Jan. 1, 2002 |
| 6,554,257 | Kenton | Apr. 29, 2003 |
| 6,585,080 | Murray | Jul. 1, 2003 |

Shuman, Jr. et al. in U.S. Pat. No. 5,522,472 teach a fall protection system for bridge construction that includes T-shaped cable supports secured to the concrete support columns of a bridle or overpass during construction. Cables are attached between the supports and receive a number of slideable, safety belt attachments. A construction worker wearing an appropriate safety harnesses is protected from falls, as the cable secures the harness and yet leaves sufficient room for normal activity of the worker.

U.S. Pat. No. 6,016,889 issued to Pearcy et al. protects a climber from falling from a pole by utilizing a housing that fits over the top of the pole which includes a swing arm extending therefrom to which a fall protection device is attached. The swing arm may also include a cam follower assembly that includes a support component spaced apart from a closed end of the housing.

Murray in U.S. Pat. No. 6,053,281 discloses a safety rail system for a rooftop. A plurality of stanchions are removably held by bases having cable receiving links. Wire ropes with winches are fixed to the stanchions. Bases include a pair of plate members connected by a hinge for adjustable attachment. A vertically-extending sleeve is fixed to the plate members which attaches to a vertical wall surface of a building.

Taormina in U.S. Pat. No. 6,068,084 teaches a safety rail for temporary attachment to balconies and stairways having an outer member and an inner member. The safety rail including apertures for pins to permit sliding two members together and locking them in place. A threaded shaft extends from one end allowing final adjustment in length.

Westerweel in U.S. Pat. No. 6,334,507 discloses a fall protection system that includes a trolley that moves along anchoring lines. The anchoring lines are arranged in a parallel spaced position. The trolley has a running gear that makes contact with the lines in a low noise and vibration manner, which enables easy passage without limiting the working space of the user.

Kenton in U.S. Pat. No. 6,554,257 teaches a safety guard rail having cast iron or welded bases and a tubular guard rail and gates. The invention allows for infinite configuration of a system to suit the needs of the user.

U.S. Pat. No. 6,585,080 issued to Murray is for a stanchion holder for a rooftop safety rail including a clamp attached to a parapet or an overhanging ledge of a roof perimeter, with an L-shaped adapter connected to the clamp. A stanchion may be inserted into the adapter which extends in a direction parallel to the clamping direction

DISCLOSURE OF THE INVENTION

A safe working environment has always been the goal of a construction company and the government has augmented these objectives by mandating safety requirements. A separate government agency has been implemented to promulgate these requirements, which is known as the United States Occupational Safety and Health Administration (OSHA). One of the requirements covers safety rails for personnel working at elevated locations. While requirements are specific for most environments, others require more workable solutions that are not fully outlined for commercial buildings, multiple story homes and apartments etc.

The primary object of the invention is to fulfill these needs by utilizing a stable guard rail that is easy to erect and yet is solid and rigid, and also fits into different environments due to its adjustable length. The invention utilizes of a pair of stanchions, preferably made of tubular steel, which are attached to the building floor or stairs with lag screws. These stanchions are light enough for a worker to manually handle and are easily attached to the floor or step using conventional hardware and tools.

A module of the safety rail consists of a pair of stanchions and a set of rails connected there between. The rails are either telescoping hollow tubes or a linked chain. Any number of modules may be easily connected together to reach any desired length.

An important object of the invention is the portability of the invention, as it is sufficiently sectionalized to be handled manually and may be moved from one construction site to another with ease and dispatch.

The ease of assembly is another feature of the invention, as when the stanchions are attached to the floor, the rails are simply placed there between, and notches in the ends of the rails mate with rings attached to the stanchions since they are adjustable in length. A pin is then placed through a hole in the rails in alignment within the inside diameter of the ring, thus permitting the rail to pivot easily for angular locations such as a set of stairs.

Another object of the invention is that the cost of the apparatus is not prohibitive, as it may be used multiple times which permits the initial expense to be amortized over a lengthy period of time.

Still another object of the invention is its versatility since it may be used in all types of building structures, even where they are sloped or have uneven ends, and may be adapted to any configuration by simply adding the appropriate number of modules together.

Yet another object of the invention is that there is an upper and a lower set of rings affixed near the top of the stanchions on the upper end, thus permitting the rigid rail to mate with the lower set. When a chain is used it is located properly in the upper rings, thereby allowing the chain to sag slightly and still meet the government requirement of top rail height from the floor.

While the invention is rigidly attached to the floor with lag screws, they may easily be removed with conventional tools, leaving only holes in the floor which will be later covered with the finished floor.

These and other objects and advantages of the present invention will become apparent from the subsequent detailed description of the preferred embodiment and the appended claims taken in conjunction with the accompanying drawings.

BRIEF DESCRIPTION OF THE DRAWINGS

FIG. 22 is a partial isometric view of the connection members on one of the stanchions in the plate embodiment, and one of the rails adjacent to the plate indicating its relative position for final connection.

FIG. 23 is a partial isometric view of the connection members on one of the stanchions in the pair of plate embodiment, and a rail adjacent to each end of the plates indicating their relative position for final connection.

FIG. 24 is a partial isometric view of the preferred pivotal attachment means in the form of a safety snap pin completely removed from the invention for clarity.

BEST MODE FOR CARRYING OUT THE INVENTION

Figure 1:
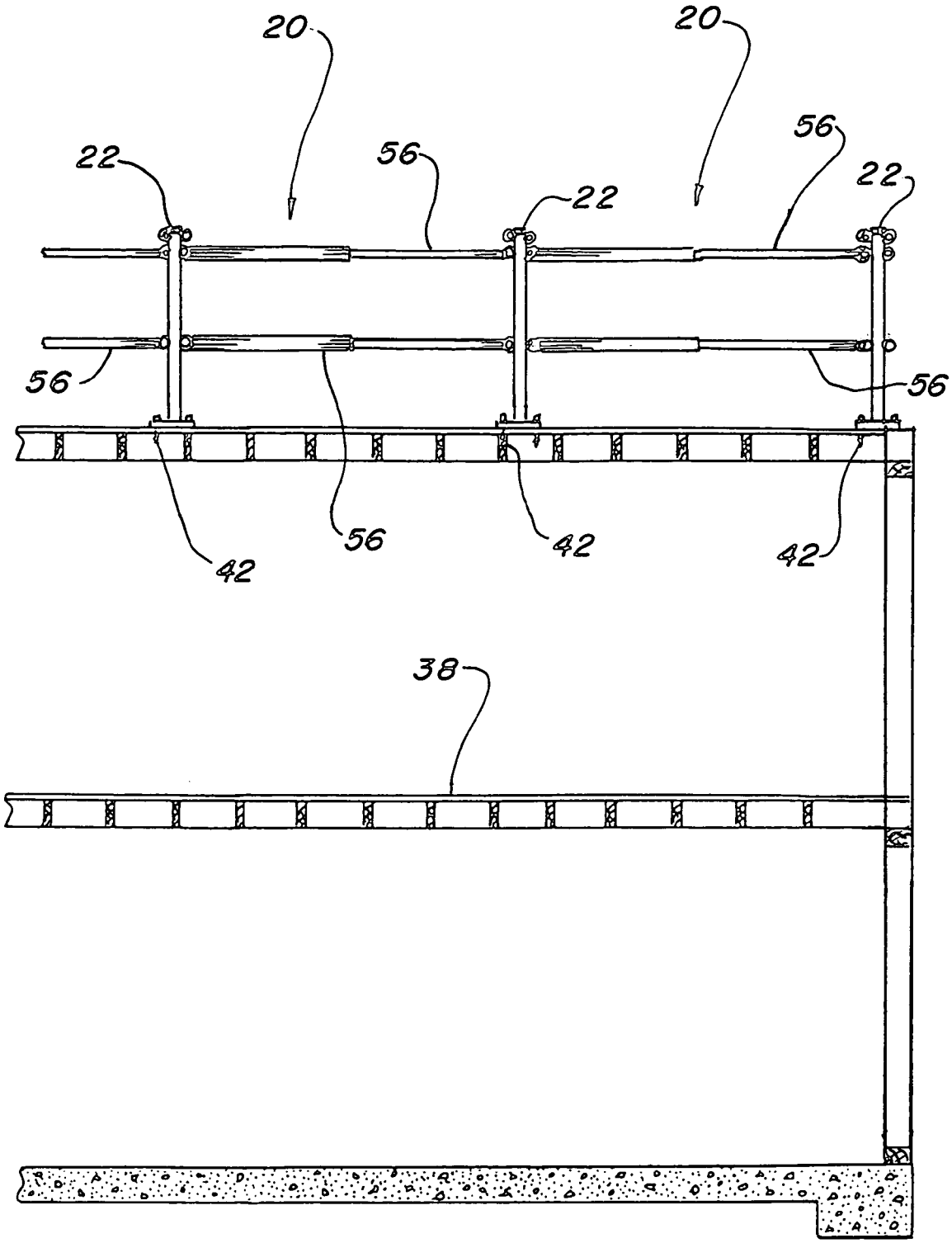
FIG. 1 is a front elevation cross sectional view of a building under construction. The safety rail in its preferred embodiment is installed on the upper floor of the building.
Figure 2:
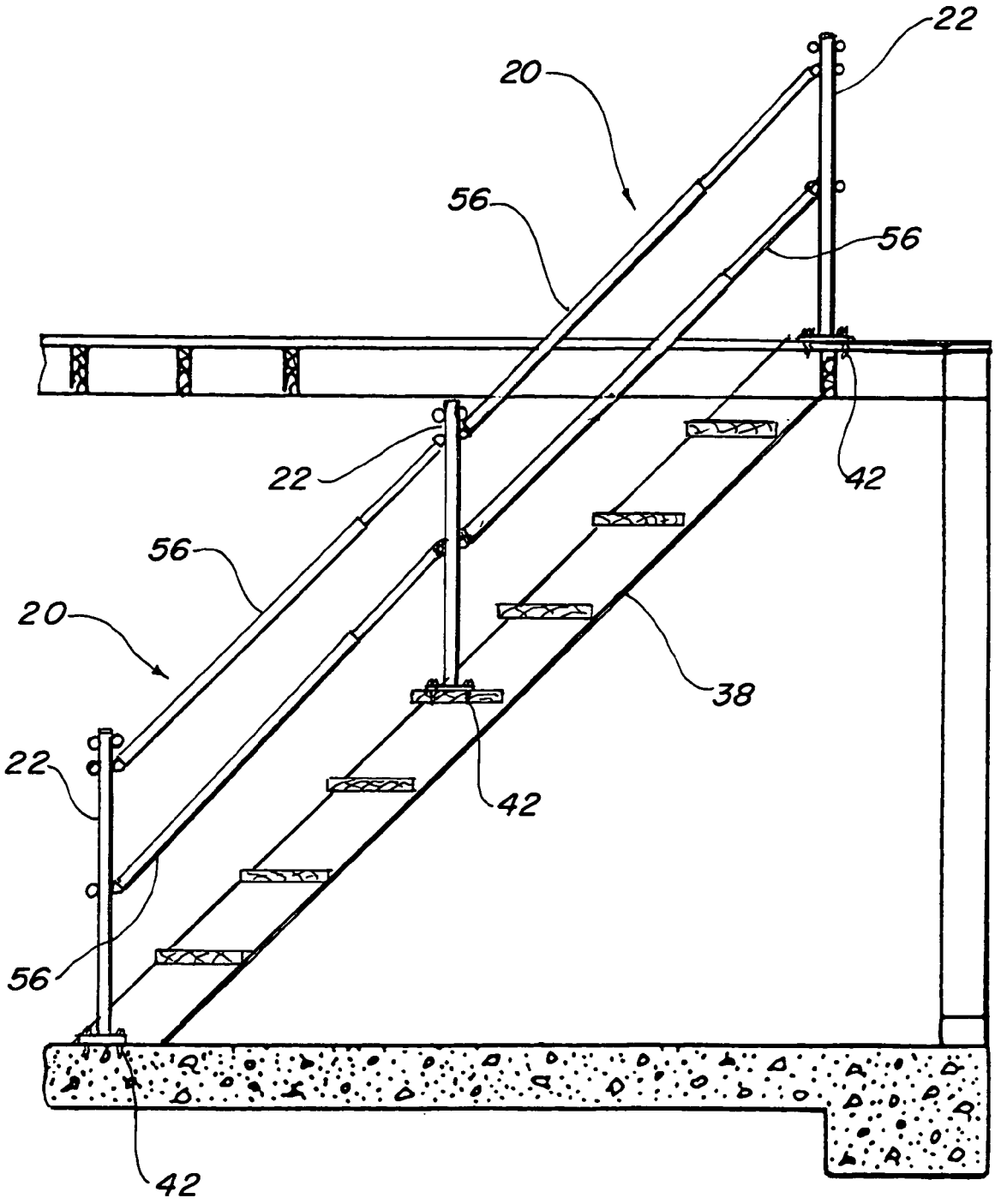
FIG. 2 is an elevation cross sectional view of a building under construction having an open set of stairs, with the safety rail in the preferred embodiment installed on the floor and stairs of the building.

The best mode for carrying out the invention is presented in terms of a preferred rigid safety rail embodiment and a second chain safety rail embodiment. The preferred embodiment of the portable rigid safety rail module 20 for protecting workers during building construction and remodeling is shown in FIGS. 1, 2, 5, 6 and 8–24 and is comprised of at least two upright stanchions 22. Each stanchion 22 is defined as having a front 24, a back 26, a right side 28, a left side 30, a top 32 and a bottom 34, as shown in the drawings, particularly FIGS. 8–12. The bottom 34 has a flat mounting plate 36 attached, preferably by welding, to the plates top center, thus permitting the mounting plate 36 to be removably fastened onto a building 38. The mounting plate 36 contains a plurality of holes 40 therethrough for bolting onto the surface of a building 38, preferably with lag screws 42, as illustrated in FIGS. 1 and 2.

The upright stanchions 22 may be in almost any configuration, such as having a square shape, which is preferred; a round shape; a rectangular shape; a channel shape; a structural beam shape, such as an I beam; or a polygonal shape, and made of a material including steel, aluminum, fiberglass or even thermoplastic. The stanchions 22 in the square or rectangular hollow configuration preferably contain a cap 44 on the top that encloses the open end for ease of handling and to eliminate debris and moisture from accumulating inside.

A number of connection members protrude from the right side 28 and left side 30 of the stanchion 22, preferably in the form of round rings 46, such as commercially available welded rings, butted rings or weldless forged rings. These round rings 46 are preferably attached to the stanchions 22 using a weld seam 48, as shown in the drawings, however the rings may include an integral stud for attachment with a nut. As the drawings indicate, there are three rings 46 on each side 28 and 30, with the top ring positioned to receive a chain rail, the middle ring is approximately 3 inches (7.62 cm) below for a rigid telescoping rail, and the lowest ring 46 for connecting a bottom rail.

While rings 46 are preferred, another variation of the connection members is illustrated in FIG. 22, which utilizes a plate member 50 instead of the ring 46. The plate member 50 is formed with a radial end and a bore 52, welded therethrough, with a weld seam 48 to the side of the stanchion 22, thereby functioning in the same manner as the ring 46.

A second variation of the connection members are depicted in FIG. 23, which replaces the rings 46 on both sides of the stanchions 22 with a pair of flat plates 54 that extend away from the stanchion's left side 30 and right side 28, with each flat plate 54 attached to the stanchions using a weld seam 48 on the front 24 and the back 26. This arrangement forms a channel-shaped connecting member on each side, and the flat plates 54 each have bores 52 therethrough for connection, again functioning the same as the rings 46.

In order to complete the safety rail module 20, at least two adjustable length rails 56 engage the connection members on two stanchions, one on each end, and the rails 56 connected in between, thus fulfilling the government requirements, provided, of course, that the attachment to the building 38 is secure.

The preferred embodiment of the adjustable length rails 56 consists of a hollow outer rigid section 58 and a hollow inner rigid section 60 forming a telescoping rail, with the inner section 60 slipping inside the outer section 58 in an adjustable length manner, as illustrated in FIGS. 1, 2, 5, 6 and 13–18. The rail sections 58 and 60 both have a hole 40 therethrough adjacent to each distal end, and a notch 62 top and bottom for connection purposes. The above details are shown best in FIG. 18, which is applicable to both the outer rigid rail section 58 and the inner rigid rail section 60, with the interface of the rigid rail section to the rings 46 also illustrated in cut away detail in FIGS. 19–21.

The shape of the adjustable length rails 56 is preferably square and hollow, as illustrated in drawings, however a round shape, a rectangular shape or a polygonal shape are also acceptable alternatives. The material may be steel, aluminum, fiberglass or thermoplastic, with square steel tubing preferred.

Figure 3:
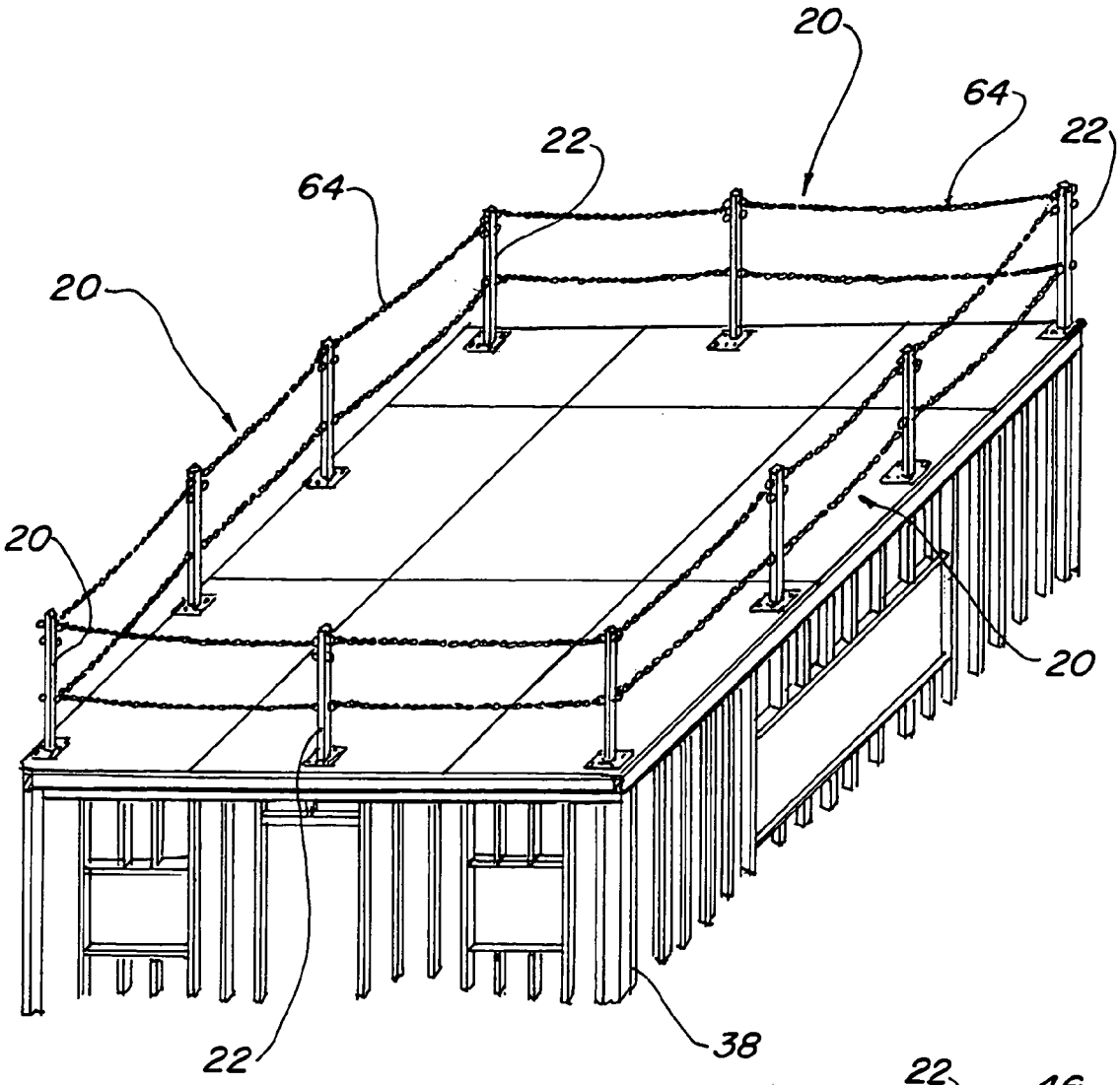
FIG. 3 is a partial isometric view of the safety rail in the chain rail embodiment installed on the top floor of a building under construction.
Figure 4:
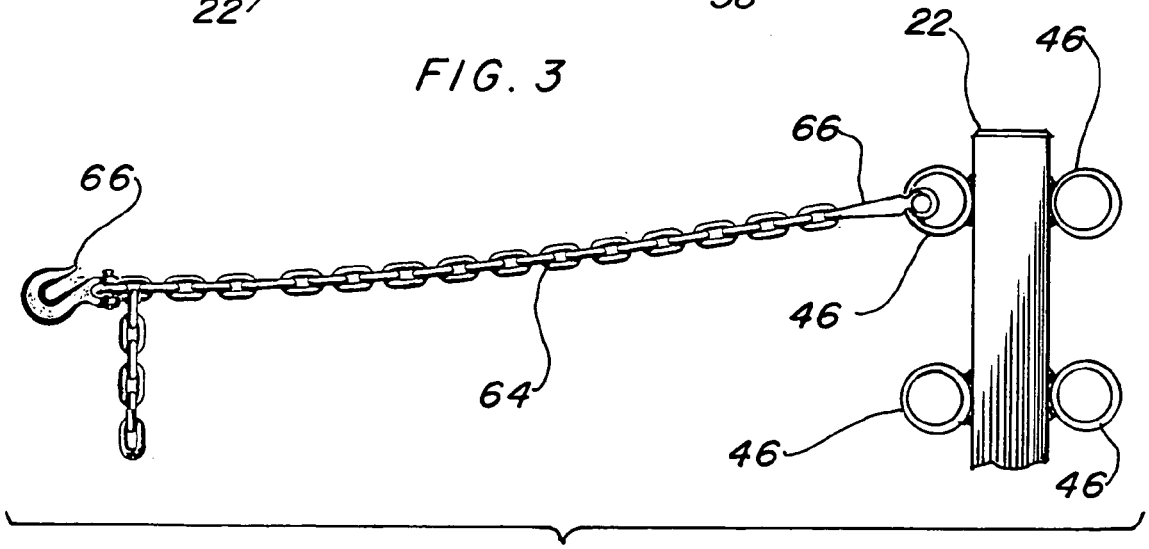
FIG. 4 is front view of one of the chains with hooks on each end completely removed from the invention for clarity.
Figure 5:
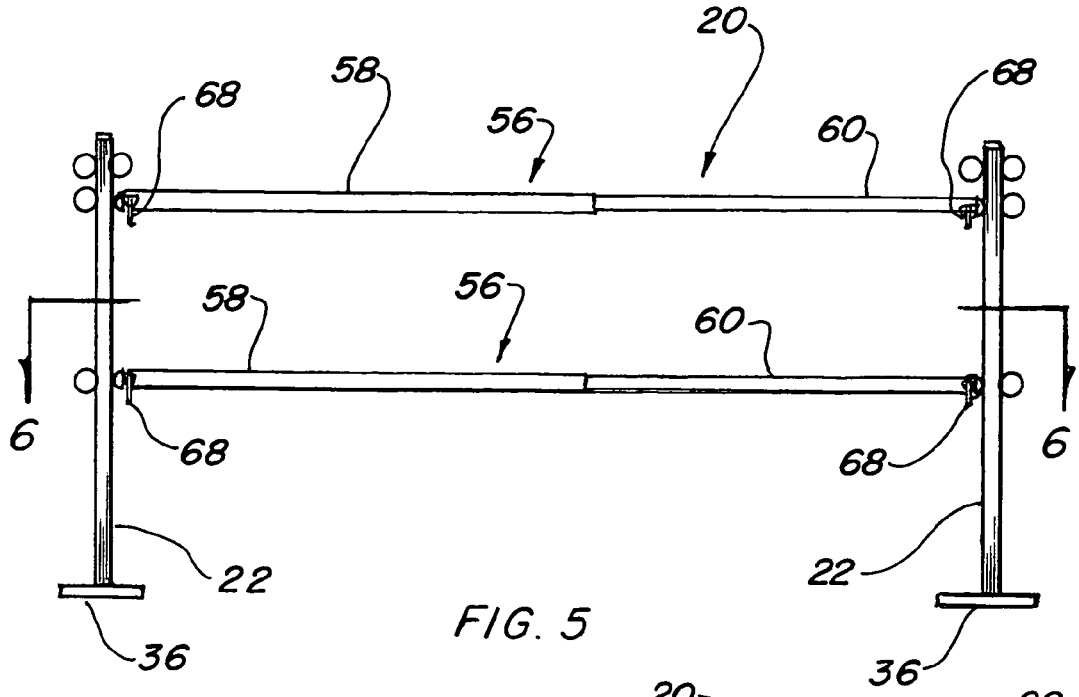
FIG. 5 is a front view of the modular safety rail in the preferred embodiment.
Figure 6:
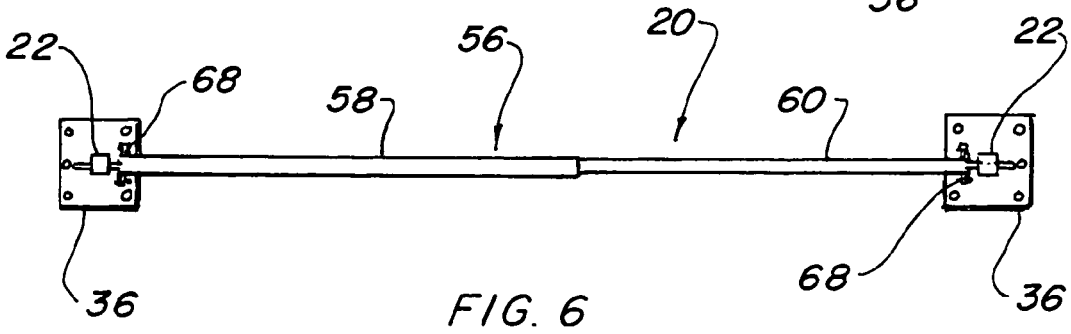
FIG. 6 is a cross-sectional view taken along lines 6—6 of FIG. 5.
Figure 7:
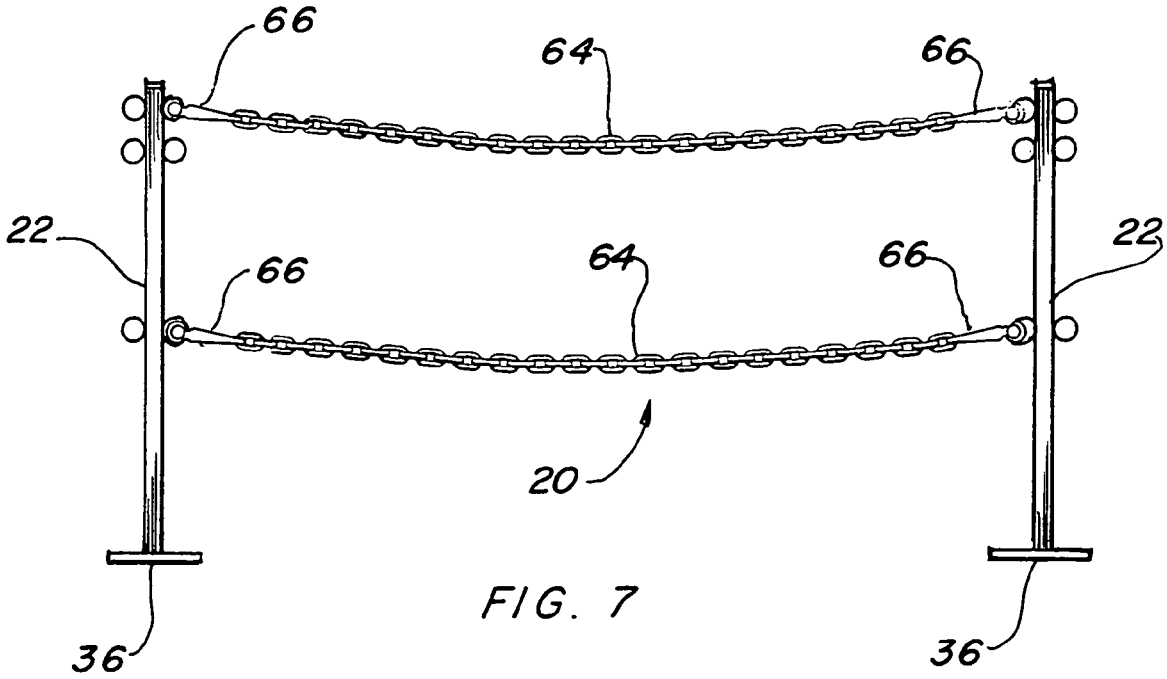
FIG. 7 is a front view of the modular safety rail in the chain rail embodiment.
Figure 8:
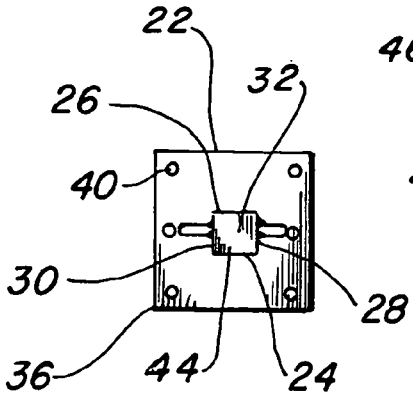
FIG. 8 is a top view of one of the upright stanchions.
Figure 9:
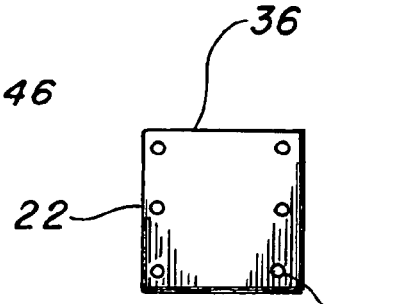
FIG. 9 is a bottom view of one of the upright stanchions.
Figure 10:
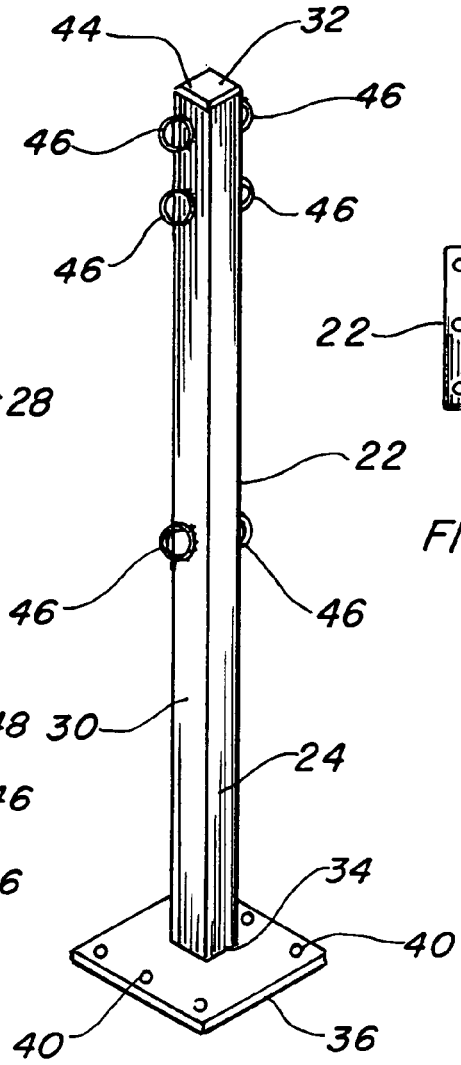
FIG. 10 is a partial isometric view of one of the upright stanchions completely removed from the invention for clarity.
Figure 11:
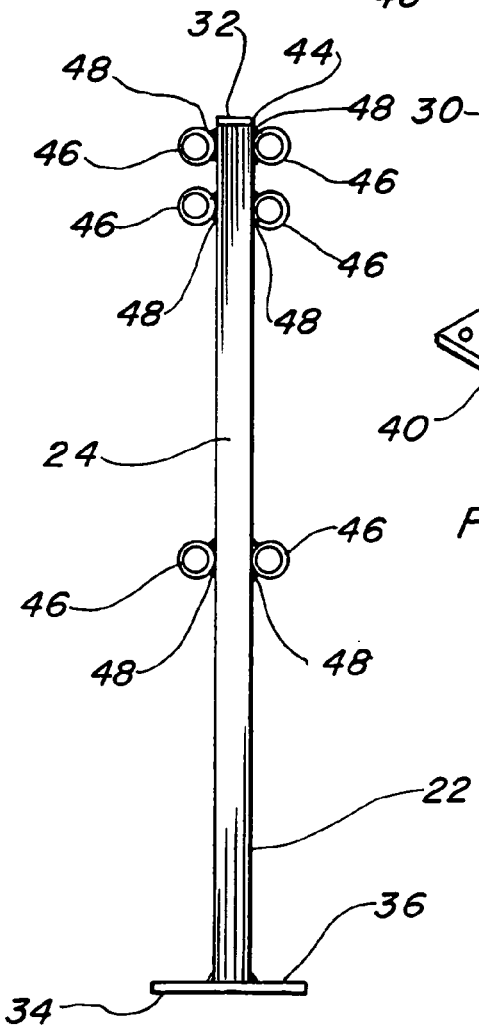
FIG. 11 is a left side view of one of the upright stanchions.
Figure 12:
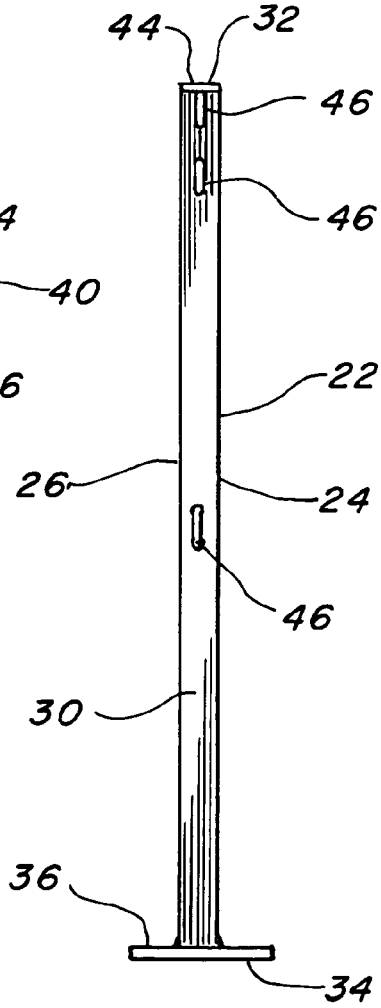
FIG. 12 is a right side view of one of the upright stanchions.
Figure 13:
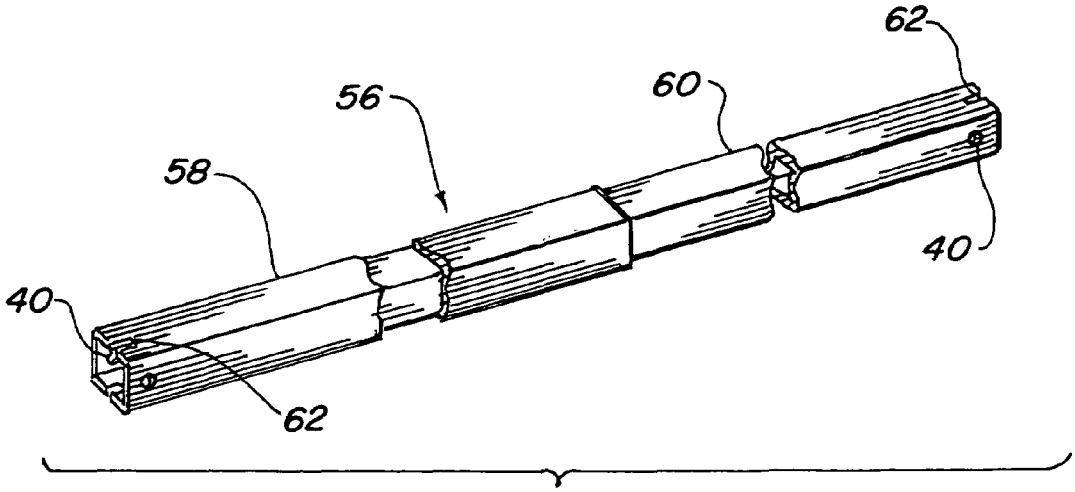
FIG. 13 is a partial isometric view of one of the rigid adjustable length rails completely removed from the invention for clarity.
Figure 14:
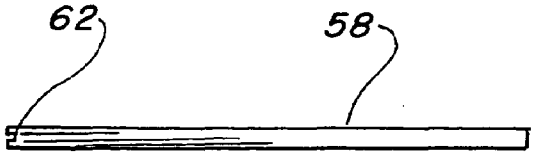
FIG. 14 is a top view of one of the outer sections of the rigid adjustable length rails completely removed from the invention for clarity.
Figure 15:
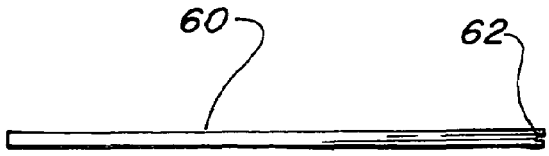
FIG. 15 is a top view of one of the inner sections of the rigid adjustable length rails completely removed from the invention for clarity.
Figure 16:
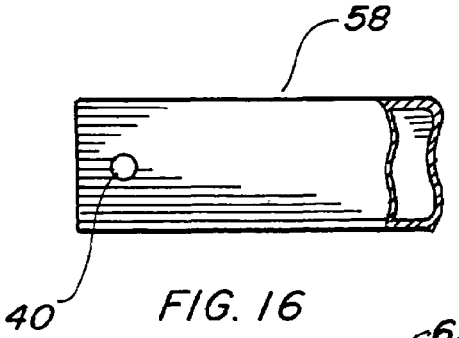
FIG. 16 is a partial side view of an outer section of the rigid adjustable length rails illustrating the hole for the attachment means.
Figure 17:
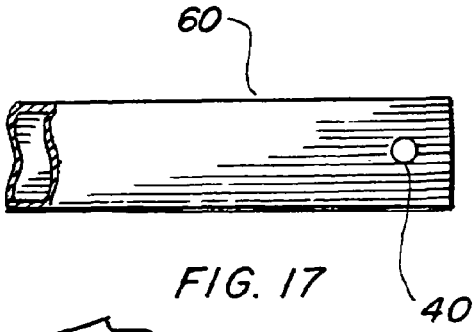
FIG. 17 is a partial side view of an inner section of the rigid adjustable length rails illustrating the hole for the attachment means.
Figure 18:
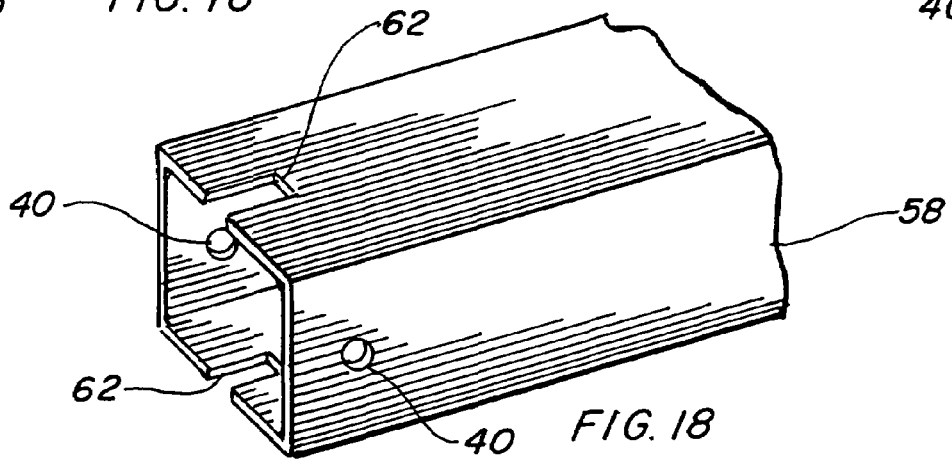
FIG. 18 is a partial top view of an outer section of the rigid adjustable length rails illustrating the notch and hole for the attachment means.

The second embodiment of the safety rail module 20 is illustrated in FIGS. 3, 4 and 7, with the adjustable length rails 56 formed by a chain 64, with a clevis hook 66 on each end interfacing with each connection member to form the requisite adjustable length. The clevis hook 66 may be attached to the chain 64 on one end, and a similar clevis hook 66 attached directly to one of the rings 46, as shown in FIG. 4, or alternately both clevis hooks 66 may be attached to the rings 46 to achieve the necessary adjustment on either end.

In the preferred rigid safety rail embodiment, pivotal attachment means are provided for fastening the rails 56 to the connecting members such that the safety rail module 20 may be horizontal when the stanchions 22 are attached to a level surface or may be angled to accommodate stairs. The attachment means preferably consists of a fastener, such as a safety snap pin, a hitch pin, a self locking clevis pin, a T-handle quick release pin, a pushbutton quick release pin, a ring-grip quick release pin, a T-handle quick release self-locking pin, a self-locking lynch pin, a snap lock pin, or a hairpin cotter. While there are a myriad of pins that function properly in the application, the safety snap pin 68 is preferred, as illustrated in FIGS. 19–21 and 24.

Figure 19:
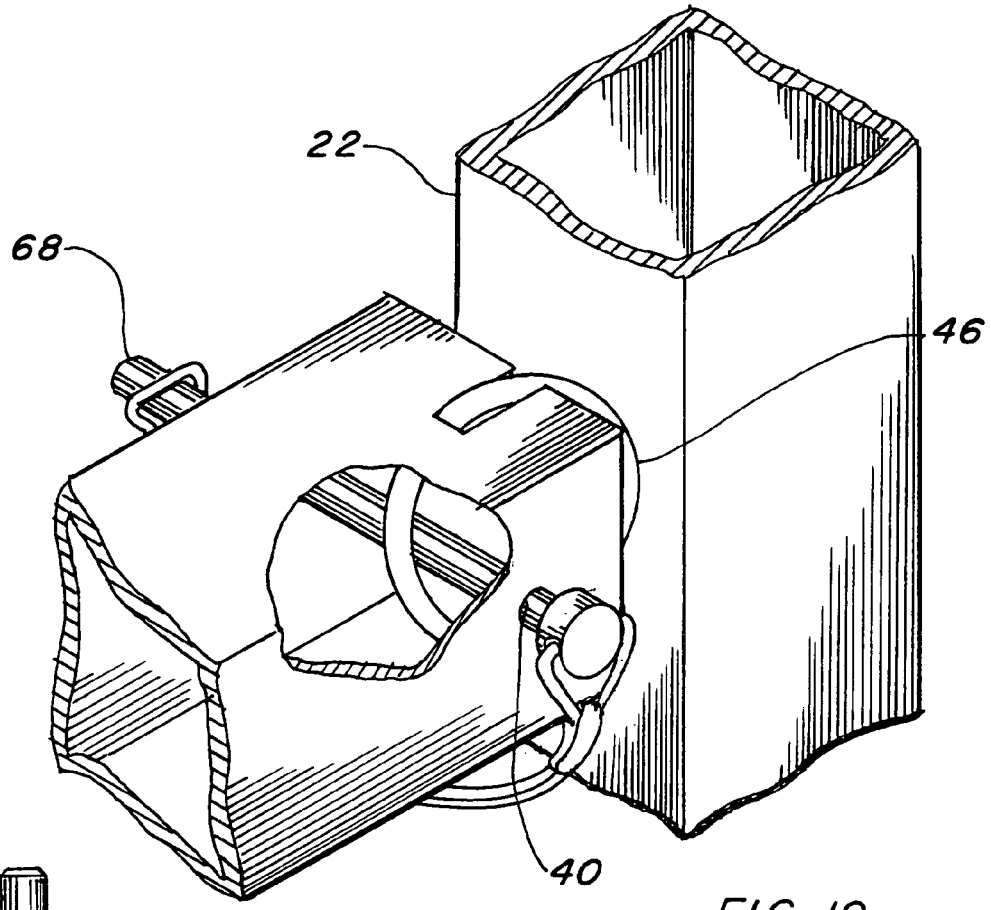
FIG. 19 is a partial isometric view of the attachment means connecting one of the rails to one of the stanchions.
Figure 20:
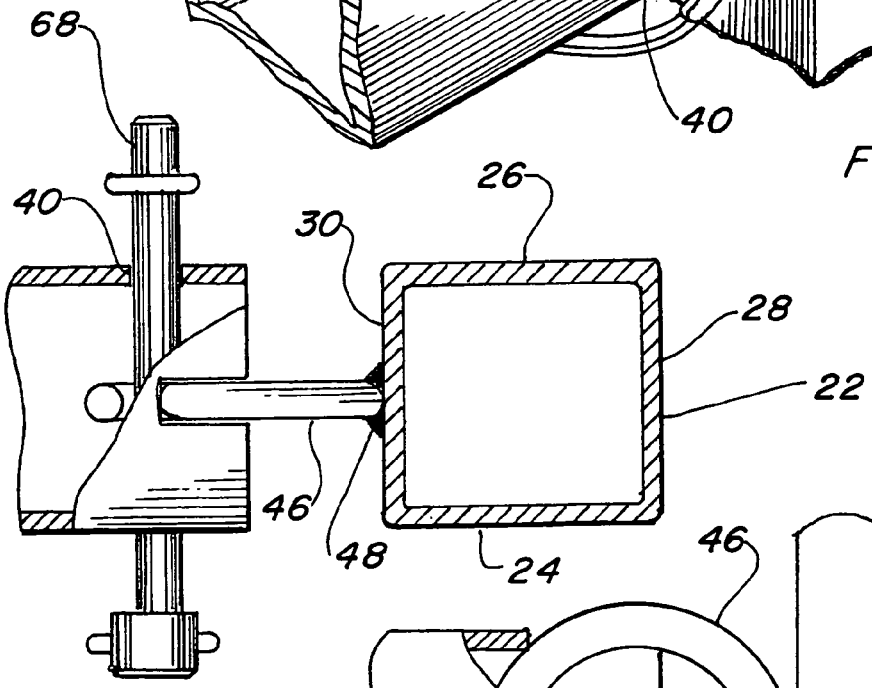
FIG. 20 is a cutaway top view of the attachment means connecting one of the rails to one of the stanchions.
Figure 21:
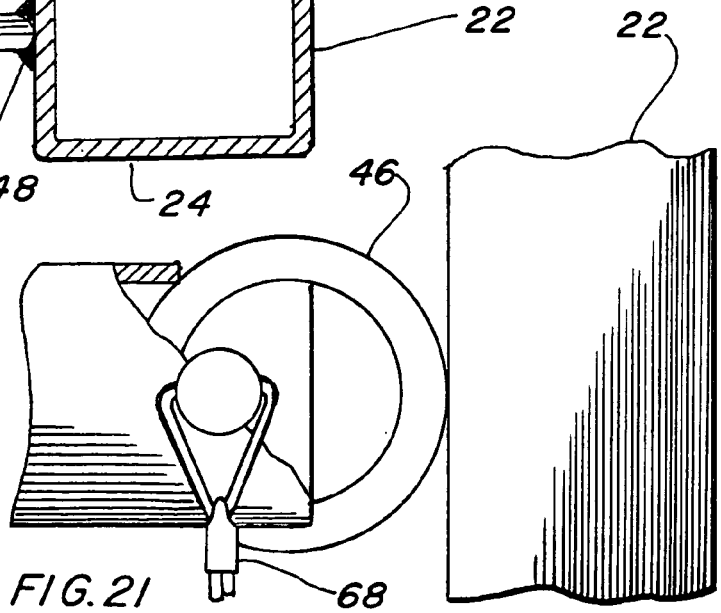
FIG. 21 is a cutaway side view of the attachment means connecting one of the rails to one of the stanchions.

To assemble the module 20 in the preferred embodiment, two stanchions 22 are spaced apart and bolted to the floor of a building 38 with lag screws 42 or the like. An adjustable length rail 56 is placed in between the stanchions 22 and one end is positioned onto a ring 46, with the notches 62 aligning and completely mating with the ring 46. A safety snap pin 68 is then inserted through the holes 40 in the rails 56 into the inside surface of the ring, as shown in FIGS. 19 and 20. The other end of the rail 56 is raised and telescoped until it interfaces with a tight fit onto the opposite ring 46. Another safety snap pin 68 is then inserted into the mating holes 40 in the rails 56, completing the attachment. The second rail 56 is assembled in like manner and other modules 22 may be added to either or both ends, as shown in the drawings. Stairs are no problem, as the attachment is pivotal, with the round rings 46 permitting angular connection in both up or down directions.

The second, or chain rail embodiment, as illustrated in FIGS. 3, 4 and 7, is assembled by bolting the stanchions 22 to the building with lag screws 42, however the adjustable length rail 56 is a chain 64 and therefore the clevis locks 66 may be already attached to the rings 46 or on one end of the chain 64. The method of linkage attachment stretching between the rings 46 is obvious, with the adjustment a mere matter of which link to attach to the accompanying clevis hook 66. Again, any number of modules 20 may be easily connected together as described.

While the invention has been described in complete detail and pictorially shown in the accompanying drawings, it is not to be limited to such details, since many changes and modifications may be made to the invention without departing from the spirit and scope thereof. Hence, it is described to cover any and all modifications and forms which may come within the language and scope of the appended claims.

The invention claimed is:

1. A portable modular safety rail for protecting workers during building construction and remodeling comprising, a) at least two upright stanchions having a front, a back, a right side, a left side, a top and a bottom, said bottom having a flat mounting plate attached there onto, with said mounting plate removably fastened onto a building, b) a plurality of connection members protruding from said right side and said left side of said stanchion, c) at least two adjustable length rails engaging said connection members on each end forming a safety rail section module, wherein said module having an outer section and an inner section forming a telescoping rail with the inner section slipping inside the outer section in an adjustable length manner, said rails further having a hole therethrough adjacent to each distal end with a notch top and bottom for pivotal attachment, and d) pivotal attachment means fastening said rails to said connecting members such that the safety rail may be horizontal when said stanchions are attached to a level surface or said stanchions may be angled to accommodate stairs.

2. The portable modular safety rail as recited in claim 1 wherein said adjustable length rails further having a shape selected from the group consisting of a square shape, a round shape, a rectangular shape and a polygonal shape.

3. The portable modular safety rail as recited in claim 2 wherein said adjustable length rails are formed from a material selected from the group consisting of steel, aluminum, fiberglass and thermoplastic.

4. The portable modular safety rail as recited in claim 1 wherein said adjustable length rails further comprise a chain.

5. The portable modular safety rail as recited in claim 4 wherein said chain includes a hook on each end for interfacing with said connection members to form an adjustable length.

6. The portable modular safety rail as recited in claim 1 wherein said pivotal attachment means further comprises a fastener selected from the group consisting of a safety snap pin, a hitch pin, a self locking clevis pin, a T-handle quick release pin, a pushbutton quick release pin, a ring-grip quick release pin, a T-handle quick release self locking pin, a self locking lynch pin, a snap lock pin and a hairpin cotter.

7. The portable modular safety rail as recited in claim 1 wherein said upright stanchions have a configuration selected from the group consisting of a square shape, a round shape, a rectangular shape, a channel shape, a structural beam shape and a polygonal shape.

8. The portable modular safety rail as recited in claim 1 wherein said upright stanchions are formed of a material selected from the group consisting of steel, aluminum, fiberglass and thermoplastic.

9. The portable modular safety rail as recited in claim 1 wherein said upright stanchions further comprise a cap on said top.

10. The portable modular safety rail as recited in claim 1 wherein each upright stanchion further comprises, said flat mounting plate having plurality of holes therethrough for bolting onto building surface.

11. The portable modular safety rail as recited in claim 1 wherein said connection members further comprise a plurality of round rings selected from the group consisting of welded rings, butted rings and weldless forged rings.

12. The portable modular safety rail as recited in claim 11 wherein said plurality of round rings are attached to said stanchions by a weld seam.

13. A portable modular safety rail for protecting workers during building construction and remodeling comprising, a) at least two upright stanchions having a front, a back, a right side, a left side, a top and a bottom, said bottom having a flat mounting plate attached there onto, with said mounting plate removably fastened onto a building, b) a plurality of connection members protruding from said right side and said left side of said stanchion, a plate member having a radial end and a bore therein, welded with a weld seam to the stanchions, c) at least two adjustable length rails engaging said connection members on each end forming a safety rail section module, and d) pivotal attachment means fastening said rails to said connecting members such that the safety rail may be horizontal when said stanchions are attached to a level surface or said stanchions may be angled to accommodate stairs.

14. A portable modular safety rail for protecting workers during building construction and remodeling comprising, a) at least two upright stanchions having a front, a back, a right side, a left side, a top and a bottom, said bottom having a flat mounting plate attached there onto, with said mounting plate removably fastened onto a building, b) a plurality of connection members protruding from said right side and said left side of said stanchion and a pair of flat plates extending away from the stanchion's left side and right side, each flat plate attached to said stanchions on the front and the back forming a channel shape connecting member, said flat plates having bores therein for pivotal attachment, c) at least two adjustable length rails engaging said connection members on each end forming a safety rail section module, and d) pivotal attachment means fastening said rails to said connecting members such that the safety rail may be horizontal when said stanchions are attached to a level surface or said stanchions may be angled to accommodate stairs.

* * * * *

UNITED STATES PATENT AND TRADEMARK OFFICE

CERTIFICATE OF CORRECTION

PATENT NO. : 7,063,186 B1
APPLICATION NO. : 10/814746
DATED : June 20, 2006
INVENTOR(S) : Gary J. Franke It is certified that error appears in the above-identified patent and that said Letters Patent is hereby corrected as shown below:

Title Page, item [76] inventor: should read - - Gary J. Franke - -

Signed and Sealed this

Twenty-ninth Day of August, 2006

JON W. DUDAS
*Director of the United States Patent and Trademark Office*